US012097895B2

(12) United States Patent
Liao

(10) Patent No.: US 12,097,895 B2
(45) Date of Patent: Sep. 24, 2024

(54) TRAIN MANAGEMENT METHOD AND SYSTEM

(71) Applicant: BYD COMPANY LIMITED, Shenzhen (CN)

(72) Inventor: Yang Liao, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 233 days.

(21) Appl. No.: 17/779,735

(22) PCT Filed: Nov. 26, 2020

(86) PCT No.: PCT/CN2020/131710
§ 371 (c)(1),
(2) Date: May 25, 2022

(87) PCT Pub. No.: WO2021/104358
PCT Pub. Date: Jun. 3, 2021

(65) Prior Publication Data

US 2023/0001966 A1 Jan. 5, 2023

(30) Foreign Application Priority Data

Nov. 29, 2019 (CN) ..... 201911204358.5

(51) Int. Cl.
*B61L 15/00* (2006.01)
*B61L 23/00* (2006.01)
*B61L 27/20* (2022.01)

(52) U.S. Cl.
CPC ..... *B61L 15/0072* (2013.01); *B61L 15/0062* (2024.01); *B61L 23/00* (2013.01); *B61L 27/20* (2022.01); *B61L 2027/204* (2022.01)

(58) Field of Classification Search
CPC .. B61L 15/0072; B61L 27/20; B61L 15/0062; B61L 23/00; B61L 2027/204
See application file for complete search history.

(56) References Cited

FOREIGN PATENT DOCUMENTS

| | | | |
|---|---|---|---|
| CN | 103029723 | A | 4/2013 |
| CN | 105035120 | A | 11/2015 |
| CN | 105035126 | A | 11/2015 |
| CN | 106672023 | A | 5/2017 |
| CN | 106741013 | A | 5/2017 |
| CN | 107738667 | A | 2/2018 |
| CN | 107878507 | A | 4/2018 |

(Continued)

OTHER PUBLICATIONS

The World Intellectual Property Organization (WIPO) International Search Report for PCT/CN2020/131710 Feb. 26, 2021 4 pages (with translation).

*Primary Examiner* — Michael D Lang
(74) *Attorney, Agent, or Firm* — Wenye Tan

(57) ABSTRACT

A train management method includes sending a registration request to a takeover zone controller (ZC) in response to determining that the train enters an area of co-management, so that the takeover ZC calculates a second movement authority (MA) of the train according to the registration request and exchanges information with a handover ZC, determining a target MA according to a first MA of the handover ZC for the train and the second MA of the takeover ZC for the train, and traveling according to the target MA within the area of co-management. The area of co-management is composed of a part of an area of management of the handover ZC and a part of an area of management of the takeover ZC.

10 Claims, 4 Drawing Sheets

(56) References Cited

FOREIGN PATENT DOCUMENTS

| | | | |
|---|---|---|---|
| CN | 107972701 | A | 5/2018 |
| CN | 108189869 | A | 6/2018 |
| CN | 109318943 | A | 2/2019 |
| EP | 3315379 | A1 | 5/2018 |
| EP | 3339133 | A1 | 6/2018 |
| IN | 106184289 | A | 12/2016 |
| WO | 2018113632 | A1 | 6/2018 |

TRAIN MANAGEMENT METHOD AND SYSTEM

CROSS-REFERENCE TO RELATED APPLICATIONS

This application is a national stage entry under 35 U.S.C. § 371 of International Application No. PCT/CN2020/131710, filed on Nov. 26, 2020, claims priority to Chinese Patent Application 201911204358.5 filed on Nov. 29, 2019 and entitled "TRAIN MANAGEMENT METHOD AND SYSTEM", the contents of all which are incorporated herein by reference in its entirety.

FIELD

The present disclosure relates to the technical field of rail transit, and more specifically, to a train management method and system.

BACKGROUND

During operation of urban rail transit, a communication based train control (CBTC for short) system provides a corresponding movement authority (MA) for each train to realize safe operation. The MA includes a route range from a minimum safe rear end of a train to a destination. A zone controller (ZC) controls, according to instructions of an automatic train supervision (ATS) system, trackside devices such as turnouts and signals to work, and sends corresponding MA information to each train in an area of management according to information about tracks within the area of management.

In the related art, a ZC corresponding to an area of management the train leaves is referred to as a handover ZC, and a ZC corresponding to an area of management the train enters is referred to as a takeover ZC. A train control system calculates an MA of a train section by section to manage operation of the train. Specifically, when the train arrives at a demarcation point of the area of management of the ZC, the takeover ZC calculates the MA of the train again, and deregisters train information of the handover ZC. In this manner, during switching of the MA, a large speed fluctuation may be caused, or even emergency braking is caused, which affects safety of train operation and reduces traveling safety of the entire system.

SUMMARY

The present disclosure provides a train management method and system, to resolve improper control of a train during handover of a movement authority (MA) by a zone controller (ZC).

In a first aspect, the present disclosure provides a train management method applicable to a train. The method includes: sending a registration request to a takeover ZC in response to determining that the train enters an area of co-management, so that the takeover ZC calculates a second MA of the train according to the registration request, and exchanges information with a handover ZC, where the area of co-management is composed of a part of an area of management of the handover ZC and a part of an area of management of the takeover ZC; determining a target MA according to a first MA of the handover ZC for the train and the second MA of the takeover ZC for the train; and traveling according to the target MA within the area of co-management.

According to the train management method in embodiments of the present disclosure, the registration request is sent to the takeover ZC when it is determined that the train enters the area of co-management, so that the takeover ZC calculates the second MA of the train according to the registration request, and exchanges the information with the handover ZC. The area of co-management is composed of a part of the area of management of the handover ZC and a part of the area of management of the takeover ZC. Then the target MA is determined according to the first MA of the handover ZC for the train and the second MA of the takeover ZC for the train. Then traveling is performed according to the target MA within the area of co-management. Therefore, when it is determined that the train enters the area of co-management, the registration request may be sent to the takeover ZC, the takeover ZC calculates the second MA of the train, and exchanges the information with the handover ZC, so as to determine the target MA according to the first MA of the handover ZC for the train and the second MA of the takeover ZC for the train. Since the train can travel within the area of co-management according to the target MA, a large speed fluctuation during switching of the MA as a result of a large difference between road information of the takeover ZC and the handover ZC is prevented, and emergency braking is prevented, thereby improving ride comfort and safety of train operation.

In a second aspect, the present disclosure provides a train management system. The system includes: a ZC and a train communicatively connected with the ZC. The ZC includes a handover ZC and a takeover ZC. The handover ZC is configured to calculate a first MA of the train. The takeover ZC is configured to calculate a second MA of the train in response to receiving a registration request sent by the train, and exchange information with the handover ZC.

According to the train management system in the embodiments of the present disclosure, the handover ZC calculates the first MA of the train, and the takeover ZC calculates the second MA of the train in response to receiving the registration request sent by the train and exchanges the information with the handover ZC. Therefore, when it is determined that the train enters the area of co-management, the registration request may be sent to the takeover ZC, the takeover ZC calculates the second MA of the train, and exchanges the information with the handover ZC, so as to determine the target MA according to the first MA of the handover ZC for the train and the second MA of the takeover ZC for the train. Therefore, the train can travel within the area of co-management according to the target MA. In this way, a large speed fluctuation during switching of the MA as a result of a large difference between road information of the takeover ZC and the handover ZC is prevented, and emergency braking is prevented, thereby improving ride comfort and safety of train operation.

In a third aspect, the present disclosure provides a computer-readable storage medium storing a computer program. When the program is executed by a processor, the steps of the method according to any of the above are implemented.

According to the computer-readable storage medium in the embodiments of the present disclosure, when the computer program stored in the computer-readable storage medium is executed by the processor, the following is realized. When it is determined that the train enters the area of co-management, the registration request may be sent to the takeover ZC, the takeover ZC calculates the second MA of the train, and exchanges the information with the handover ZC, so as to determine the target MA according to the first MA of the handover ZC for the train and the second MA of the takeover ZC for the train. Therefore, the train can travel within the area of co-management according to the target MA. In this way, a large speed fluctuation during switching of the MA as a result of a large difference between road information of the takeover ZC and the handover ZC is prevented, and emergency braking is prevented, thereby improving ride comfort and safety of train operation.

In a fourth aspect, the present disclosure provides an electronic device. The electronic device includes: a memory, storing a computer program; and a processor, configured to execute the computer program in the memory to implement the steps of the method according to any of the above.

According to the electronic device in the embodiments of the present disclosure, by performing the above train management method, the following is realized. When it is determined that the train enters the area of co-management, the registration request may be sent to the takeover ZC, the takeover ZC calculates the second MA of the train, and exchanges the information with the handover ZC, so as to determine the target MA according to the first MA of the handover ZC for the train and the second MA of the takeover ZC for the train. Therefore, the train can travel within the area of co-management according to the target MA. In this way, a large speed fluctuation during switching of the MA as a result of a large difference between road information of the takeover ZC and the handover ZC is prevented, and emergency braking is prevented, thereby improving ride comfort and safety of train operation.

Other aspects and advantages of the present disclosure will be given in the following description, some of which will become apparent from the following description or may be learned from practices of the present disclosure.

BRIEF DESCRIPTION OF THE DRAWINGS

The foregoing and/or additional aspects and advantages of the present disclosure will become apparent and comprehensible in the description made with reference to the following accompanying drawings, where.

DETAILED DESCRIPTION

The following describes embodiments of the present disclosure in detail. Examples of the embodiments are shown in the accompanying drawings, and same or similar reference signs in all the accompanying drawings indicate same or similar components or components having same or similar functions. The embodiments described below with reference to the accompanying drawings are exemplary, and are intended to explain the present disclosure and cannot be construed as a limitation to the present disclosure.

When a train arrives at a demarcation point of an area of management of a zone controller (ZC), a takeover ZC needs to calculate a movement authority (MA) of the train to control operation of the train. The process may result in a large speed fluctuation during switching of the MA as a result of a large difference between road information of the takeover ZC and a handover ZC, or even results in emergency braking, which affects safety of train operation. In addition, when the handover ZC hands over the train to the takeover ZC, train information of the train in the handover ZC is deregistered. As a result, the handover ZC cannot calculate MAs of other trains within the area of management based on the vehicle information of the train, which reduces driving safety of the entire system.

Figure 1:
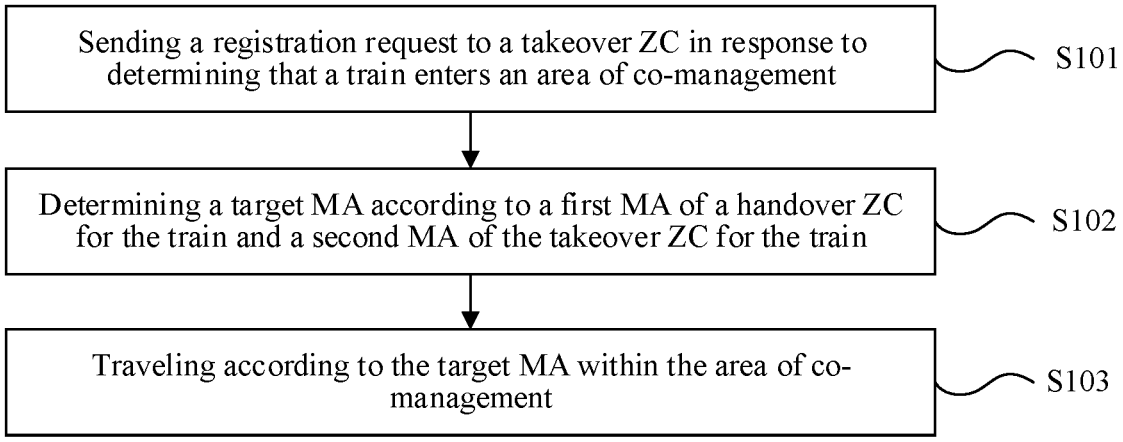
FIG. 1 is a flowchart of a train management method according to an implementation of the present disclosure.

FIG. 1 is a flowchart of a train management method according to an implementation of the present disclosure. The method is applicable to a train. As shown in FIG. 1, the train management method includes the following steps:

S101: A registration request is sent to a takeover ZC in response to determining that the train enters an area of co-management, so that the takeover ZC calculates a second MA of the train according to the registration request, and exchanges information with a handover ZC.

The area of co-management is composed of a part of an area of management of the handover ZC and a part of an area of management of the takeover ZC.

S102: A target MA is determined according to a first MA of the handover ZC for the train and the second MA of the takeover ZC for the train.

S103: Traveling is performed according to the target MA within the area of co-management.

The area of co-management is obtained according to a maximum speed of the train within the area of management and a calculated time for the ZC to receive the registration request and calculate the second MA. The area of co-management is composed of a part of the area of management of the handover ZC and a part of the area of management of the takeover ZC. For example, if a maximum vehicle speed within the area of management of the handover ZC is 240 kilometers/hour, and the takeover ZC requires 30 seconds to calculate the second MA, the calculated area of co-management is 2 kilometers.

When the train travels within the area of management of the handover ZC, the handover ZC calculates the first MA of the train according to information about trackside devices such as turnouts and signal lights within the area of management. In this case, the train travels according to the first MA. If the train travels toward the area of management of the takeover ZC, the registration request is sent to the takeover ZC when it is determined that the train has entered the area of co-management. The takeover ZC calculates the second MA of the train according to information about trackside devices such as turnouts and signal lights within the area of management. The takeover ZC exchanges the information with the handover ZC, to determine information within the area of co-management. The information includes the turnover information. In this way, accuracy of calculating the second MA by the takeover ZC and accuracy of calculating the first MA by the handover ZC are improved.

The train determines the target MA within a range of road section according to the received first MA and second MA. Therefore, the train can travel within the area of co-management according to the determined target MA.

According to the above technical solution, when it is determined that the train enters the area of co-management, the registration request is sent to the takeover ZC, the takeover ZC calculates the second MA of the train, and exchanges the information with the handover ZC, so as to determine the target MA according to the first MA of the handover ZC for the train and the second MA of the takeover ZC for the train. Therefore, the train can travel within the area of co-management according to the target MA. In this way, a large speed fluctuation during switching of the MA as a result of a large difference between road information of the takeover ZC and the handover ZC is prevented, and emergency braking is prevented, thereby improving ride comfort and safety of train operation.

In this embodiment, the MA is used for indicating a route range of an obstacle ahead from a current position of the train. The determination of the target MA according to the first MA of the handover ZC for the train and the second MA of the takeover ZC for the train includes: determining a distance between a destination of a route range indicated by a first MA received at each moment and the current position of the train and a distance between a destination of a route range indicated by a second MA received at each moment and the current position of the train; and selecting, as the target MA, an MA that indicates a route range having a destination closer to the current position of the train.

Figure 2:
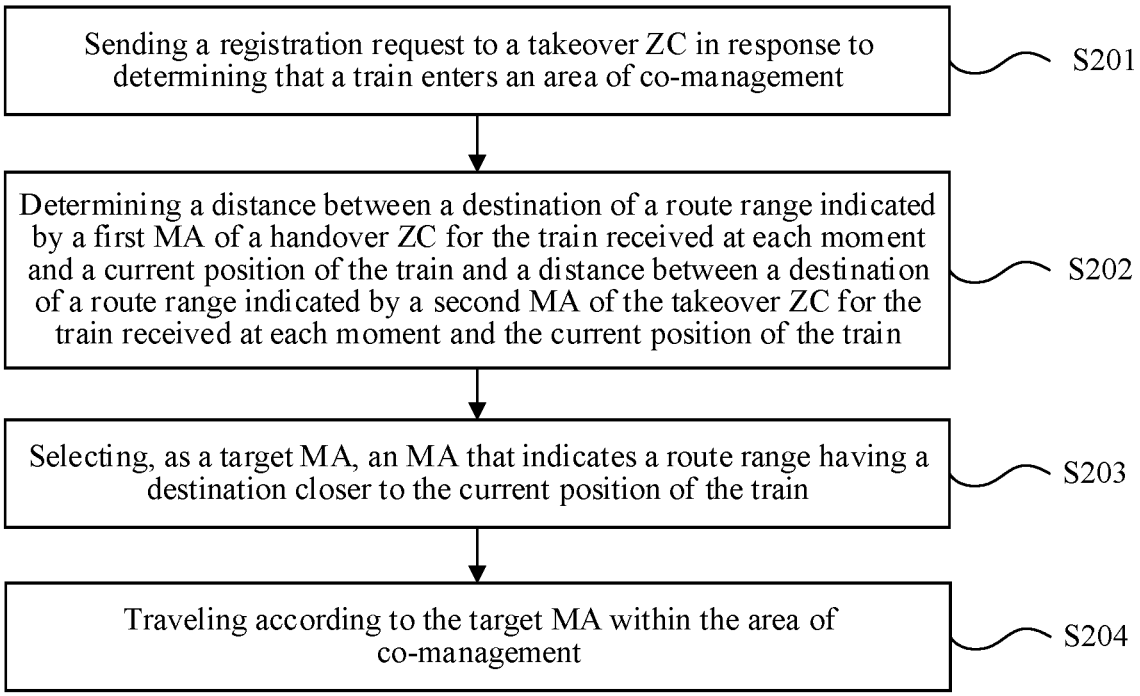
FIG. 2 is a flowchart of a train management method according to another implementation of the present disclosure.

FIG. 2 is a flowchart of a train management method according to another implementation of the present disclosure. As shown in FIG. 2, the train management method includes the following steps:

- S201: A registration request is sent to a takeover ZC in response to determining that a train enters an area of co-management.
- S202: A distance between a destination of a route range indicated by a first MA of a handover ZC for the train received at each moment and a current position of the train and a distance between a destination of a route range indicated by a second MA of the takeover ZC for the train received at each moment and the current position of the train are determined.
- S203: An MA that indicates a route range having a destination closer to the current position of the train is selected as a target MA.
- S204: Traveling is performed according to the target MA within the area of co-management.

The obstacle ahead indicated in the MA may be a destination, a turnout, a train ahead, or the like in a traveling direction. The MA is used for indicating the route range of the obstacle ahead from the current position of the train. For example, in a traveling direction of a train 1 #, a faulty train 2 #is stopped at a position 5 kilometers away from the current position of the train 1 #, where a minimum safe rear end of the train 2 #is 5 kilometers away from a minimum safe rear end of the train 1 #. In this case, the MA is used for indicating a route range of 5 kilometers from the minimum safe rear end of the train 2 #to a minimum safe rear end of the current position of the train 1 #.

For example, the first MA received at a moment is an MA for a route range of 500 meters to 1 kilometer ahead, and a second MA received at the same time is an MA for a route range of 500 meters to 1.2 kilometers ahead. Since a destination of the first MA is 1 kilometer away from the current position of the train, which is less than the 1.2 kilometers by which a destination of the second MA is away from the current position of the train, the first MA that indicates the route range having the destination closer to the current position of the train is selected as the target MA, and traveling is performed according to that target MA.

In another example, the first MA received at a moment is an MA for a route range of 500 meters to 1.5 kilometers ahead, and a second MA received at the same time is an MA for a route range of 400 meters to 1.2 kilometers ahead. Since a destination of the second MA is 1.2 kilometers away from the current position of the train, which is less than the 1.5 kilometers by which a destination of the first MA is away from the current position of the train, the second MA that indicates the route range having the destination closer to the current position of the train is selected as the target MA, and traveling is performed according to that target MA.

According to the above technical solution, the train may select, as the target MA, the MA that indicates a route range having a destination closer to the current position of the train, thereby realizing proper control of a speed of the train and improving traveling safety of the train.

The determination that the train enters the area of co-management includes determining that a minimum safe rear end of the train enters the area of co-management.

Generally, a position of a head of the train may be determined according to cab positioning information of an activated train, and then a safe position of the train may be determined according to the position of the head of the train and a length of the train. However, due to errors which may include positive errors and negative errors, the safe position of the train may include a safe front end of the train and a safe rear end of the train. The safe front end of the train is a position range from a maximum safe front end and a minimum safe front end of the train. The maximum safe front end is a position of the head of the train determined according to the positioning data of the train and a positive accuracy error, and the minimum safe front end is a position of the head of the train determined according to the positioning data of the train and a negative accuracy error.

Correspondingly, the safe rear end of the train is a position range from a maximum safe rear end to a minimum safe rear end of the train. The maximum safe rear end is a position of a tail of the train determined according to the positioning data of the train, a positive accuracy error, and a length of the train, and the minimum safe rear end is a position of the tail of the train determined according to the positioning data of the train, a negative accuracy error, and the length of the train.

The safe position of the train is a range from the maximum safe front end of the train to the minimum safe rear end of the train. By determining that the minimum safe rear end of the train enters the area of co-management, it can be ensured that the takeover ZC can acquire the above train information, thereby properly calculating the second MA. In this way, calculation of the MA of the train in the entire takeover ZC is more proper, and the train operation is safer.

In this embodiment, the train management method further includes performing, by the train, braking in a case that communication of the train with the ZC is interrupted during traveling within the area of co-management.

Figure 3:
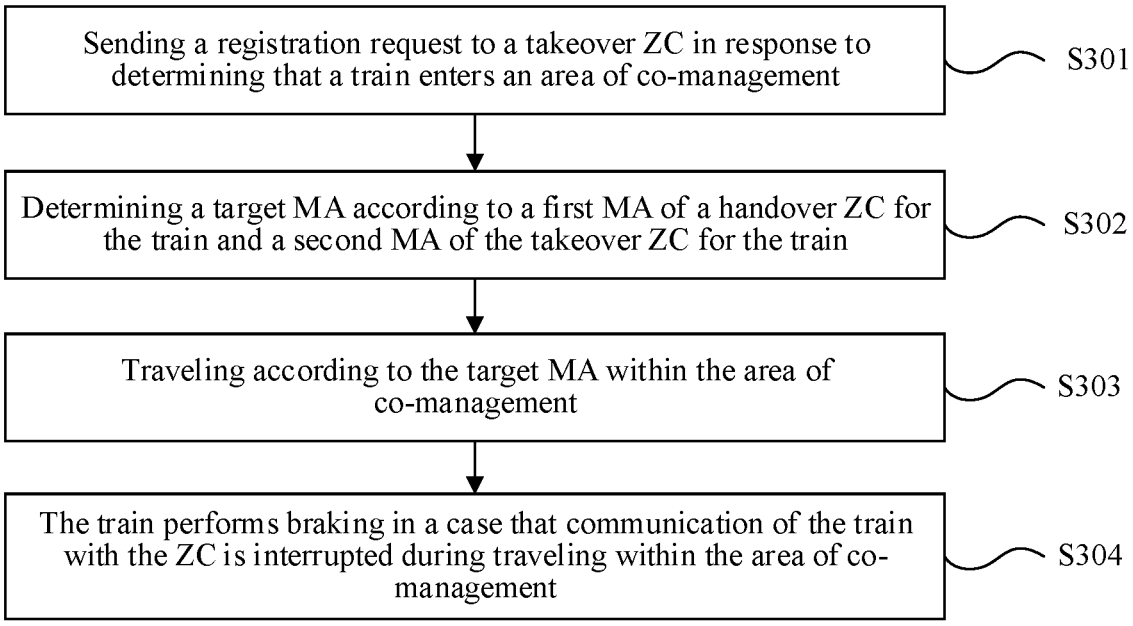
FIG. 3 is a flowchart of a train management method according to another implementation of the present disclosure.

FIG. 3 is a flowchart of a train management method according to another implementation of the present disclosure. As shown in FIG. 3, the train management method includes the following steps:

- S301: A registration request is sent to a takeover ZC in response to determining that a train enters an area of co-management.
- S302: A target MA is determined according to a first MA of a handover ZC for the train and a second MA of a takeover ZC for the train.

S303: Traveling is performed according to the target MA within the area of co-management.

S304: The train performs braking in a case that communication of the train with the ZC is interrupted during traveling within the area of co-management.

During traveling within the area of co-management, if the communication of the train with the ZC is interrupted, for example, only the second MA is received and the first MA is not received, or only the first MA is received and the second MA is not received, or neither the second MA nor the first MA is received, the train performs braking.

For example, communication of the train with the handover ZC is interrupted during traveling within the area of co-management. In this case, only the second MA is received. Therefore, the train performs downgrade braking. An original automatic train supervision (ATS) system controls the train to lower an automatic operation grade, and the train starts braking. The handover ZC exchanges information with the takeover ZC to obtain the position information of the train, and the handover ZC marks a section occupied by the train as occupied to recalculate MAs of other trains within the area of management.

In another example, communication of the train with the takeover ZC is interrupted during traveling within the area of co-management. In this case, only the first MA is received. Therefore, the train voluntarily performs level lowering and braking. The ATS system controls the train to lower the automatic operation grade, and the train starts braking. The handover ZC exchanges information with the takeover ZC to obtain the position information of the train, and the takeover ZC marks a section occupied by the train as occupied to recalculate MAs of other trains within the area of management.

In another example, communication of the train with the handover ZC and the takeover ZC is interrupted during traveling within the area of co-management. A communication based train control (CBTC) system controls the train to lower the grade from fully automatic operation to restricted manual driving, and force braking is performed. In addition, a section occupied by the train is marked as occupied, and other trains approaching the section are forbidden by MAs of corresponding ZCs from entering the section. For example, a train that normally travels displays information of a signal on an onboard display, to prompt driving in an iATP mode protected by train control.

In this embodiment, when a train without a communication signal enters the area of co-management, the train cannot acquire an MA and therefore cannot travel according to the MA. In this case, the train performs braking to avoid a safety accident.

In a possible implementation, the train management method further includes: sending a handover request to the handover ZC in response to determining that a maximum safe front end of the train leaves the area of co-management, so that the handover ZC stops calculating the first MA.

Figure 4:
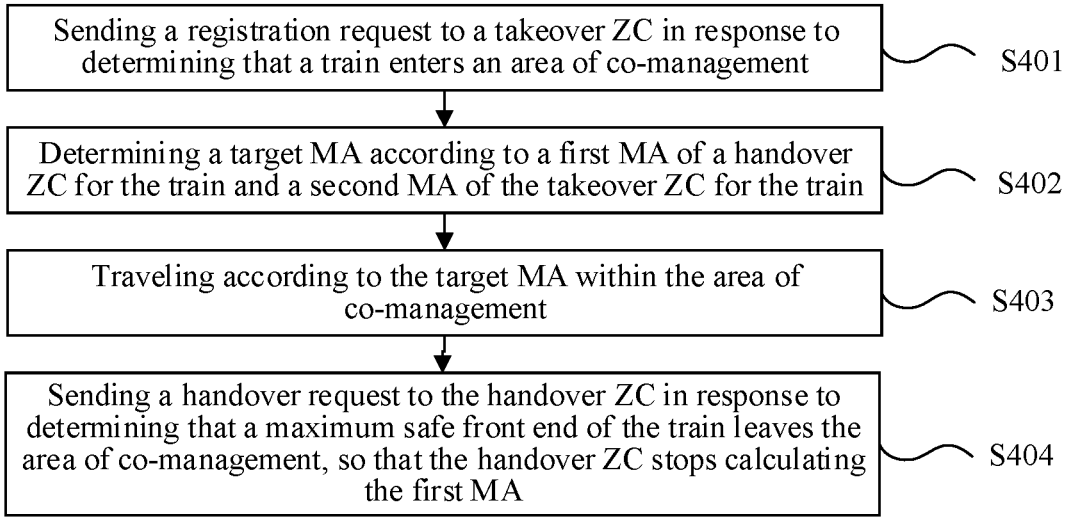
FIG. 4 is a flowchart of a train management method according to another implementation of the present disclosure.

FIG. 4 is a flowchart of a train management method according to another implementation of the present disclosure. As shown in FIG. 4, the train management method includes the following steps:

S401: A registration request is sent to a takeover ZC in response to determining that a train enters an area of co-management.

S402: A target MA is determined according to a first MA of a handover ZC for the train and a second MA of a takeover ZC for the train.

S403: Traveling is performed according to the target MA within the area of co-management.

S404: A handover request is sent to the handover ZC in response to determining that a maximum safe front end of the train leaves the area of co-management, so that the handover ZC stops calculating the first MA.

When it is determined that the maximum safe front end of the train leaves the area of co-management, the train sends the handover request to the handover ZC, so that the handover ZC stops calculating the first MA. However, at this time, the takeover ZC sends the second MA to the handover ZC by means of information exchange. The first MA received by the train is same as the received second MA of the takeover ZC. Therefore, the train operates according to the second MA.

For example, when a train 1 #determines that the maximum safe front end leaves the area of co-management, the 1 #train sends the handover request to the handover ZC, that is, an MA of the 1 #train is handed over to the takeover ZC. When the handover ZC receives the handover request, the handover ZC stops calculating a first MA of the 1 #train, and normally calculates first MAs of other trains that normally travel within an area of management of the handover ZC. At this time, the handover ZC acquires a second MA of the train 1 #by means of information exchange, and adjusts the MAs of the other trains that normally travel within the area of management of the handover ZC according to the second MA of the train 1 #. The train 1 #travels according to the received first MA of the handover ZC and the received second MA of the takeover ZC.

In this embodiment, the train management method further includes: sending a deregistration request to the handover ZC in response to determining that a minimum safe rear end of the train leaves the area of co-management.

Figure 5:
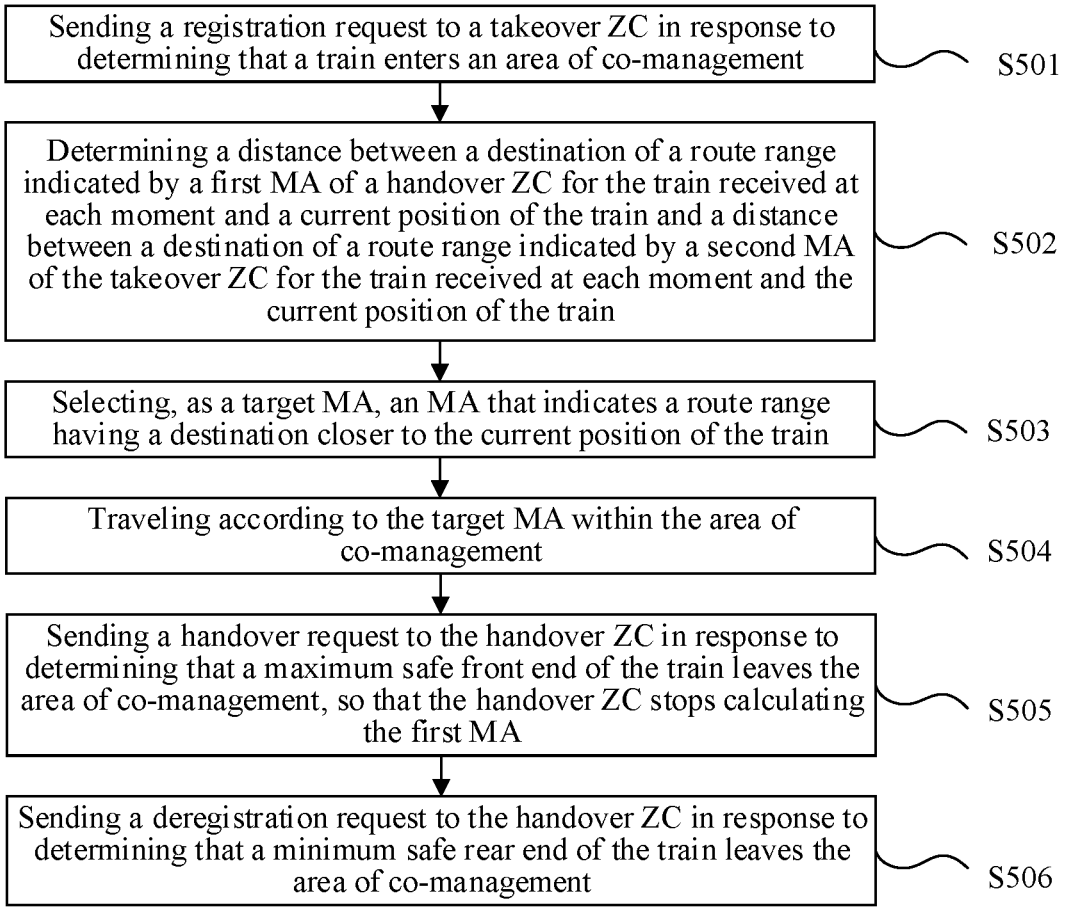
FIG. 5 is a flowchart of a train management method according to another implementation of the present disclosure.

FIG. 5 is a flowchart of a train management method according to another implementation of the present disclosure. As shown in FIG. 5, the train management method includes the following steps:

S501: A registration request is sent to a takeover ZC in response to determining that a train enters an area of co-management.

S502: A distance between a destination of a route range indicated by a first MA of a handover ZC for the train received at each moment and a current position of the train and a distance between a destination of a route range indicated by a second MA of the takeover ZC for the train received at each moment and the current position of the train are determined.

S503: An MA that indicates a route range having a destination closer to the current position of the train is selected as a target MA.

S504: Traveling is performed according to the target MA within the area of co-management.

S505: A handover request is sent to the handover ZC in response to determining that a maximum safe front end of the train leaves the area of co-management, so that the handover ZC stops calculating the first MA.

S506: A deregistration request is sent to the handover ZC in response to determining that a minimum safe rear end of the train leaves the area of co-management.

In this embodiment, the deregistration request that is sent includes position information of the train. Therefore, the handover ZC may calculate an MA of a train traveling in an area of management according to the position information, so as to prevent the train traveling within the area of management from being affected as a result of conflicting geographical positions of trains, thereby improving safety of train traveling.

For example, the deregistration request sent by a train 1 #to the handover ZC includes position information of the train 1 #. The handover ZC calculates the MA of the train traveling within the area of management by using a minimum safe rear end of the train 1 #as general position information of the train ahead.

In this embodiment, if the train does not send the deregistration request to the handover ZC when it is determined that the minimum safe rear end of the train leaves the area of co-management, the train sends an alarm prompt by using an alarm device in a cab, continues traveling according to the second MA, and sends the deregistration request to the takeover ZC. After receiving the deregistration request, the takeover ZC sends the deregistration request to the handover ZC during periodic interaction with the handover ZC.

According to the above technical solution, when the train leaves the area of management of the handover ZC, the position information of the train is acquired, so that the handover ZC may calculate the MAs of other trains within the area of management according to the vehicle information of the train. In this way, driving safety of the entire system is improved.

Figure 6:
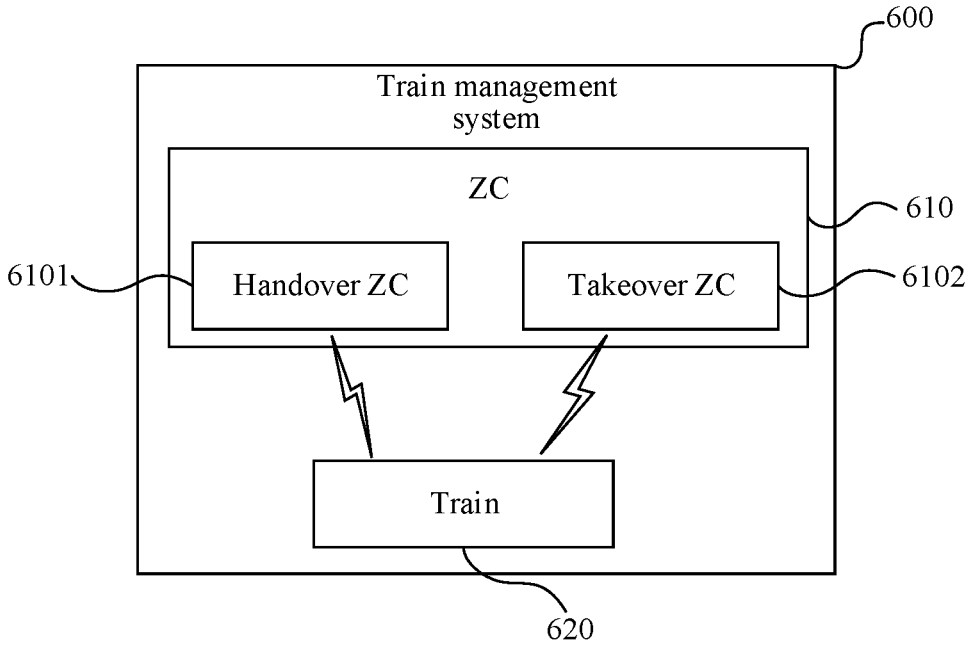
FIG. 6 is a block diagram of a train management system according to an implementation of the present disclosure.

FIG. 6 is a block diagram of a train management system according to an implementation of the present disclosure. As shown in FIG. 6, the train management system 600 includes a ZC 610 and a train 620 communicatively connected with the ZC 610.

The ZC 610 includes a handover ZC 6101 and a takeover ZC 6102.

The handover ZC 6101 is configured to calculate a first MA of the train 620. The takeover ZC 6102 is configured to calculate a second MA of the train 620 in response to receiving a registration request sent by the train 620, and exchange information with the handover ZC 6101.

According to the above technical solution, when it is determined that the train enters the area of co-management, the registration request is sent to the takeover ZC, the takeover ZC calculates the second MA of the train, and exchanges the information with the handover ZC, so that a target MA may be determined according to the first MA of the handover ZC for the train and the second MA of the takeover ZC for the train. Therefore, the train can travel within the area of co-management according to the target MA. In this way, a large speed fluctuation during switching of the MA as a result of a large difference between road information of the takeover ZC and the handover ZC is prevented, and emergency braking is prevented, thereby improving ride comfort and safety of train operation.

Optionally, the handover ZC 6101 is further configured to: stop calculating the MA for the train 620 in response to receiving a handover request sent by the train 620; and calculate an MA of the train within an area of management according to position information of the train 620 in a deregistration request in response to receiving the deregistration request sent by the train 620.

Optionally, the train 620 includes an onboard controller configured to: receive the first MA and the second MA; determine a distance between a destination of a route range indicated by a first MA received at each moment and the current position of the train and a distance between a destination of a route range indicated by a second MA received at each moment and the current position of the train; select, as the target MA, an MA that indicates a route range having a destination closer to the current position of the train 620; and control, according to the target MA, the train 620 to travel within the area of co-management.

Optionally, the onboard controller is further configured to control the train 620 to perform braking in a case that communication of the train 620 with the ZC 610 is interrupted during traveling within the area of co-management.

Since the specific implementations have been described in application to the train management method, for description, refer to the above embodiments and drawings, and detailed description is not provided herein.

Figure 7:
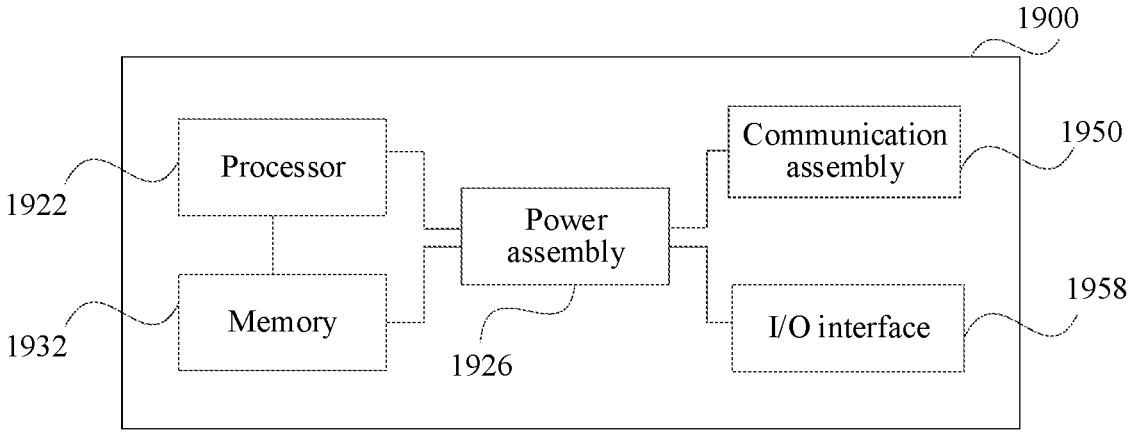
FIG. 7 is a block diagram of an electronic device according to an implementation of the present disclosure.

FIG. 7 is a block diagram of an electronic device according to an implementation of the present disclosure. For example, the electronic device 1900 may be provided as a server. Referring to FIG. 7, the electronic device 1900 may include one or more processors 1922 and a memory 1932 configured to store a computer program executable by the processor 1922. The computer program stored in the memory 1932 may include one or more modules each corresponding to a set of instructions. Moreover, the processor 1922 may be configured to execute the computer program to perform the above train management method.

In addition, the electronic device 1900 may further include a power supply assembly 1926 and a communication assembly 1950. The power supply assembly 1926 may be configured to perform power management on the electronic device 1900, and the communication assembly 1950 may be configured to implement communication of the electronic device 1900, such as wired or wireless communication. Furthermore, the electronic device 1900 may further include an input/output (I/O) interface 1958. The electronic device 1900 may operate an operating system stored in the memory 1932, such as Windows Server™, Mac OS X™, Unix™, and Linux™.

In another exemplary embodiment, a computer-readable storage medium storing a computer program is further provided. When the computer program is executed by a processor, the steps of the above train management method are implemented. For example, the computer-readable storage medium may be the above memory 1932 including the program instruction. The program instruction may be executed by the processor 1922 of the electronic device 1900 to complete the above train management method.

In another exemplary embodiment, a computer program product is further provided. The computer program product includes a computer program executable by a programmable apparatus. The computer program has a code part, when executed by the programmable apparatus, being for performing the above train management method.

The exemplary embodiments of the present disclosure are described in detail above with reference to the accompanying drawings, but the present disclosure is not limited to the specific details in the above embodiments. Various simple variations may be made to the technical solutions of the present disclosure within the scope of the technical idea of the present disclosure, and such simple variations shall all fall within the protection scope of the present disclosure.

It should be further noted that the specific technical features described in the above specific embodiments may be combined in any suitable manner without contradiction. To avoid unnecessary repetition, various possible combinations are not further described in the present disclosure.

In addition, the various embodiments of the present disclosure may be combined without departing from the idea of the present disclosure, and such combinations shall also fall within the scope of the present disclosure.

What is claimed is:

1. A train management method for a train, the method comprising:

sending a registration request to a takeover zone controller (ZC) in response to determining that the train enters an area of co-management, so that the takeover ZC calculates a second movement authority (MA) of the train according to the registration request, and exchanges information with a handover ZC, wherein the area of co-management is composed of a part of an area of management of the handover ZC and a part of an area of management of the takeover ZC, and the area of co-management is obtained according to a maximum speed of the train within the area of management and a calculated time for the takeover ZC to receive the registration request and calculate the second MA;

determining a target MA according to a first MA of the handover ZC for the train and the second MA of the takeover ZC for the train; and traveling according to the target MA within the area of co-management.

2. The method according to claim 1, wherein the MA is used for indicating a route range of an obstacle ahead from a current position of the train, and the determining a target MA according to a first MA of the handover ZC for the train and the second MA of the takeover ZC for the train comprises:

determining a distance between a destination of a route range indicated by a first MA received at each moment and the current position of the train and a distance between a destination of a route range indicated by a second MA of the takeover ZC for the train received at each moment and the current position of the train; and selecting, as the target MA, an MA that indicates a route range having a destination closer to the current position of the train.

3. The method according to claim 1, wherein the determining that the train enters an area of co-management comprises:

determining that a minimum safe rear end of the train enters the area of co-management.

4. The method according to claim 1, further comprising:

performing, by the train, braking in a case that communication of the train with the ZC is interrupted during traveling within the area of co-management.

5. The method according to claim 1, further comprising:

sending a handover request to the handover ZC in response to determining that a maximum safe front end of the train leaves the area of co-management, so that the handover ZC stops calculating the first MA.

6. The method according to claim 1, further comprising:

sending a deregistration request to the handover ZC in response to determining that the minimum safe rear end of the train leaves the area of co-management.

7. A train management system, comprising a zone controller (ZC) and a train communicatively connected with the ZC, wherein the ZC comprises a handover ZC and a takeover ZC;

the handover ZC is configured to calculate a first movement authority (MA) of the train;

and the takeover ZC is configured to calculate a second MA of the train in response to receiving a registration request sent by the train, and exchange information with the handover ZC, wherein the train sends the registration request to the takeover ZC in response to determining that the train enters an area of co-management, so that the takeover ZC calculates the second MA of the train according to the registration request; the area of co-management is composed of a part of an area of management of the handover ZC and a part of an area of management of the takeover ZC; and the area of co-management is obtained according to a maximum speed of the train within the area of management and a calculated time for the takeover ZC to receive the registration request and calculate the second MA.

8. The system according to claim 7, wherein the train comprises an onboard controller configured to:

receive the first MA and the second MA;

determine a distance between a destination of a route range indicated by a first MA received at each moment and the current position of the train and a distance between a destination of a route range indicated by a second MA received at each moment and the current position of the train;

select, as a target MA, an MA that indicates a route range having a destination closer to the current position of the train;

control, according to the target MA, the train to travel within the area of co-management.

9. A computer-readable storage medium storing a computer program, wherein when the program is executed by a processor, the processor implementing a train management method, applied to a train, the method comprising:

sending a registration request to a takeover zone controller (ZC) in response to determining that the train enters an area of co-management, so that the takeover ZC calculates a second movement authority (MA) of the train according to the registration request, and exchanges information with a handover ZC, wherein the area of co-management is composed of a part of an area of management of the handover ZC and a part of an area of management of the takeover ZC, and the area of co-management is obtained according to a maximum speed of the train within the area of management and a calculated time for the takeover ZC to receive the registration request and calculate the second MA;

determining a target MA according to a first MA of the handover ZC for the train and the second MA of the takeover ZC for the train; and traveling according to the target MA within the area of co-management.

10. An electronic device, comprising:

a memory, storing a computer program; and a processor, configured to execute the computer program in the memory to implement a train management method, applied to a train, the method comprising:

sending a registration request to a takeover zone controller (ZC) in response to determining that the train enters an area of co-management, so that the takeover ZC calculates a second movement authority (MA) of the train according to the registration request, and exchanges information with a handover ZC, wherein the area of co-management is composed of a part of an area of management of the handover ZC and a part of an area of management of the takeover ZC, and the area of co-management is obtained according to a maximum speed of the train within the area of management and a calculated time for the takeover ZC to receive the registration request and calculate the second MA;

determining a target MA according to a first MA of the handover ZC for the train and the second MA of the takeover ZC for the train; and traveling according to the target MA within the area of co-management.

* * * * *